US008414222B2

(12) United States Patent
DiTullio

(10) Patent No.: US 8,414,222 B2
(45) Date of Patent: Apr. 9, 2013

(54) RISER ASSEMBLY FOR WATER STORAGE CHAMBERS

(76) Inventor: Robert J. DiTullio, Warren, CT (US)

( * ) Notice: Subject to any disclaimer, the term of this patent is extended or adjusted under 35 U.S.C. 154(b) by 259 days.

(21) Appl. No.: 12/814,211

(22) Filed: Jun. 11, 2010

(65) Prior Publication Data

US 2011/0305513 A1 Dec. 15, 2011

(51) Int. Cl.
*E02B 13/00* (2006.01)

(52) U.S. Cl.
USPC ..... 405/46

(58) Field of Classification Search ..... 405/36, 405/39, 40, 43, 45, 46, 49, 51; 210/170.08; 137/236.1
See application file for complete search history.

(56) References Cited

U.S. PATENT DOCUMENTS

| | | | | |
|---|---|---|---|---|
| 2,153,789 | A | 4/1939 | Carswell et al. | |
| 2,767,801 | A | 10/1956 | Eads | |
| 3,897,090 | A | 7/1975 | Maroschak | |
| 3,926,222 | A | 12/1975 | Shroy et al. | |
| 5,087,151 | A | 2/1992 | DiTullio | |
| 5,156,488 | A | 10/1992 | Nichols | |
| 5,419,838 | A * | 5/1995 | DiTullio | 210/747.3 |
| 5,617,679 | A * | 4/1997 | Meyers | 52/20 |
| 5,773,756 | A | 6/1998 | DiTullio | |
| 5,890,838 | A * | 4/1999 | Moore et al. | 405/49 |
| 6,129,482 | A | 10/2000 | DiTullio | |
| 6,322,288 | B1 | 11/2001 | DiTullio | |
| 6,361,248 | B1 | 3/2002 | Maestro | |
| 6,612,777 | B2 | 9/2003 | Maestro | |
| 6,837,652 | B1 * | 1/2005 | Rost et al. | 405/40 |
| 7,004,221 | B2 * | 2/2006 | Moore et al. | 164/6 |
| 7,004,677 | B1 * | 2/2006 | Ericksen et al. | 405/51 |
| 7,052,209 | B1 | 5/2006 | Kruger et al. | |
| 7,118,306 | B2 * | 10/2006 | Kruger et al. | 405/49 |
| 7,226,241 | B2 * | 6/2007 | DiTullio | 405/46 |
| 7,425,261 | B2 | 9/2008 | Siviter et al. | |
| 7,473,053 | B1 * | 1/2009 | Brochu et al. | 405/49 |
| 7,637,691 | B1 * | 12/2009 | DiTullio | 405/49 |
| D613,819 | S * | 4/2010 | DiTullio | D23/207 |
| D638,095 | S * | 5/2011 | Ditullio | D23/202 |

(Continued)

FOREIGN PATENT DOCUMENTS

| | | | |
|---|---|---|---|
| DE | 10143985 | C1 | 1/2003 |
| DE | 202005012192 | U1 | 11/2005 |
| GB | 2475551 | A | 5/2011 |

OTHER PUBLICATIONS

Great Britain Search Report; Application No. GB1109712.8; Issued: Jul. 4, 2011; 1 page.

(Continued)

*Primary Examiner* — Thomas B Will
*Assistant Examiner* — Patrick Lambe
(74) *Attorney, Agent, or Firm* — St. Onge Steward Johnston & Reens LLC

(57) ABSTRACT

A drainage system includes a storm water chamber and riser assembly for gathering and dispensing liquids. The storm water chamber comprises a generally elongated arch shape with an arch top and bottom side walls, thereby defining an enclosure. The riser assembly has two generally parallel base assemblies, which each have an outer wall and an inner wall and a top wall connecting the outer wall and the inner wall. The top wall has a chamber seating area for receiving the base area of the chamber and a retaining element for retaining the base area of a chamber in position in the chamber seating area.

22 Claims, 7 Drawing Sheets

U.S. PATENT DOCUMENTS

| | | | | |
|---|---|---|---|---|
| 8,002,497 | B2 * | 8/2011 | Hedstrom et al. | 405/46 |
| 8,007,016 | B2 * | 8/2011 | Mantyla et al. | 292/200 |
| 8,147,688 | B2 * | 4/2012 | Adams et al. | 210/170.03 |
| 2002/0025226 | A1 | 2/2002 | Maestro | |
| 2002/0154951 | A1 * | 10/2002 | Gamache | 405/43 |
| 2003/0145527 | A1 * | 8/2003 | Meyers | 52/20 |
| 2005/0074288 | A1 * | 4/2005 | Moore, Jr. | 405/46 |
| 2005/0077301 | A1 * | 4/2005 | Bolzer et al. | 220/567.1 |
| 2005/0100410 | A1 * | 5/2005 | Maestro | 405/46 |
| 2005/0111915 | A1 * | 5/2005 | Moore et al. | 405/46 |
| 2005/0238434 | A1 * | 10/2005 | Coppes et al. | 405/49 |
| 2006/0182497 | A1 * | 8/2006 | Potts | 405/46 |
| 2006/0233612 | A1 * | 10/2006 | DiTullio | 405/46 |
| 2007/0077122 | A1 * | 4/2007 | Birchler et al. | 405/46 |
| 2007/0258770 | A1 * | 11/2007 | Miskovich | 405/43 |
| 2008/0226394 | A1 * | 9/2008 | Coppes et al. | 405/49 |
| 2008/0240859 | A1 * | 10/2008 | Sipaila | 405/46 |
| 2009/0279953 | A1 * | 11/2009 | Allard et al. | 405/39 |

OTHER PUBLICATIONS

Cultec, Inc.; Cultec Patented Interlocking Rib Connection (printout from www.cultec.com web pages); Oct. 2001.

Cultec, Inc.; Plastic Septic and Stormwater Chambers (printout from www.cultec.com web pages); Sep. 2002.

St. Marseille, J.G.; Anderson, B.C.; "Use of Leaching Chambers for On-Site Sewage Treatment"; 2002; Environmental Technology, vol. 23, pp. 261-272.

* cited by examiner

RISER ASSEMBLY FOR WATER STORAGE CHAMBERS

FIELD OF THE INVENTION

The present invention relates to storm water chambers for collecting and dispensing storm water to the ground.

BACKGROUND OF THE INVENTION

Storm water runoff collected from roof areas and paved areas were historically simply allowed to collect in municipal storm water drainage systems and transferred to a body of water. However, more recently, the preferred handling of storm water runoff is to direct it into soil, and such handling is required by building codes in many cases. The traditional construction of storm water handling systems has been concrete tanks or infiltration trenches filled with large gravel or crushed stone with perforated pipes running therethrough.

Molded chamber structures are increasingly taking the place of concrete structures for use in leaching fields or to gather storm water runoff. Molded chamber structures provide a number of distinct advantages over traditional concrete tanks. For example, concrete tanks are extremely heavy requiring heavy construction equipment to put them in place. In leaching fields and storm water collection systems, the gravel used in constructing them is difficult to work with and expensive. It also tends to settle and reduces the overall volume of the trench by as much as 75%. Stone-filled trench systems are expensive and inefficient since the stone occupies a substantial volume, limiting the ability of the system to handle large surge volumes of water associated with heavy storms. Both the stone and the perforated pipe are also susceptible to clogging by particles or debris carried by water.

Molded plastic chamber structures have been introduced in the market for handling storm water. U.S. Pat. No. 5,087,151 to DiTullio, the disclosure of which is hereby incorporated by reference, discloses a drainage and leaching field system comprising vacuum-molded polyethylene chambers that are designed to be connected and locked together in an end-to-end fashion.

Such chambers typically have an arch-shaped cross-section and are relatively long with open bottoms for dispersing water to the ground. These chambers may be laid on a gravel bed side-by-side in parallel rows to create large drainage systems. End portions of the chambers may be connected to a catch basin, typically through a pipe network, in order to efficiently distribute high velocity storm water. The chambers are typically positioned in a trench on top of a bed of materials that facilitates the flow of fluid into the earth.

However, such chambers become increasingly more difficult to manufacture and handle the larger they are designed. Consequently, the volume of liquids that can be accommodated by drainage chambers is limited by the ability to manufacture and ship them.

It would be desirable if molded plastic structures could be used in larger volume applications, where the benefits of ease of installation and cost savings could be available.

SUMMARY OF THE INVENTION

One embodiment of the system of the present teachings comprises, but is not limited to a storm water chamber having a first end and a second end, two side walls running the length between the first end and second end, and a generally elongated arch shape between the side walls with an arch top, thereby defining an enclosure. The storm water chamber also has a connector on the second end for connecting a further storm water chamber and a plurality of circumferential reinforcing members disposed along the generally elongated arch shape for reinforcing structural strength thereof. A riser assembly has two generally parallel base assemblies each having a first end, a second end, and a top, the tops of the two generally parallel base assemblies having a member for securing the side walls of the storm water chamber thereto. The riser assembly also has a connector on the second end for connecting a further riser assembly and a cross-sectional support between the two generally parallel base assemblies. An enlarged enclosure is created when the liquid dispersing chamber is connected with the riser assembly and liquid is directed into the first end of the storm water chamber for collection or dispersal.

One embodiment of the method of the present teachings comprises, but is not limited, connecting the storm water chamber with the riser assembly, positioning the storm water chamber and the riser assembly in proximity with the ground, and directing liquid into the storm water chamber and the riser assembly for dispersal to the ground.

Other embodiments of the system are described in detail below and are also part of the present teachings.

For a better understanding of the present embodiments, together with other and further aspects thereof, reference is made to the accompanying drawings and detailed description, and its scope will be pointed out in the appended claims.

DETAILED DESCRIPTION OF THE INVENTION

The present teachings are described more fully hereinafter with reference to the accompanying drawings, in which the present embodiments are shown. The following description is presented for illustrative purposes only and the present teachings should not be limited to these embodiments.

Storm water chambers have been used for gathering and dispensing liquids such as, for example, storm water and waste water into the ground. Such storm water chambers are disclosed in U.S. Pat. No. 7,226,241, entitled Storm Water Chamber For Ganging Together Multiple Chambers, assigned to Cultec, Inc., which this application incorporates by reference in its entirety.

Figure 1:
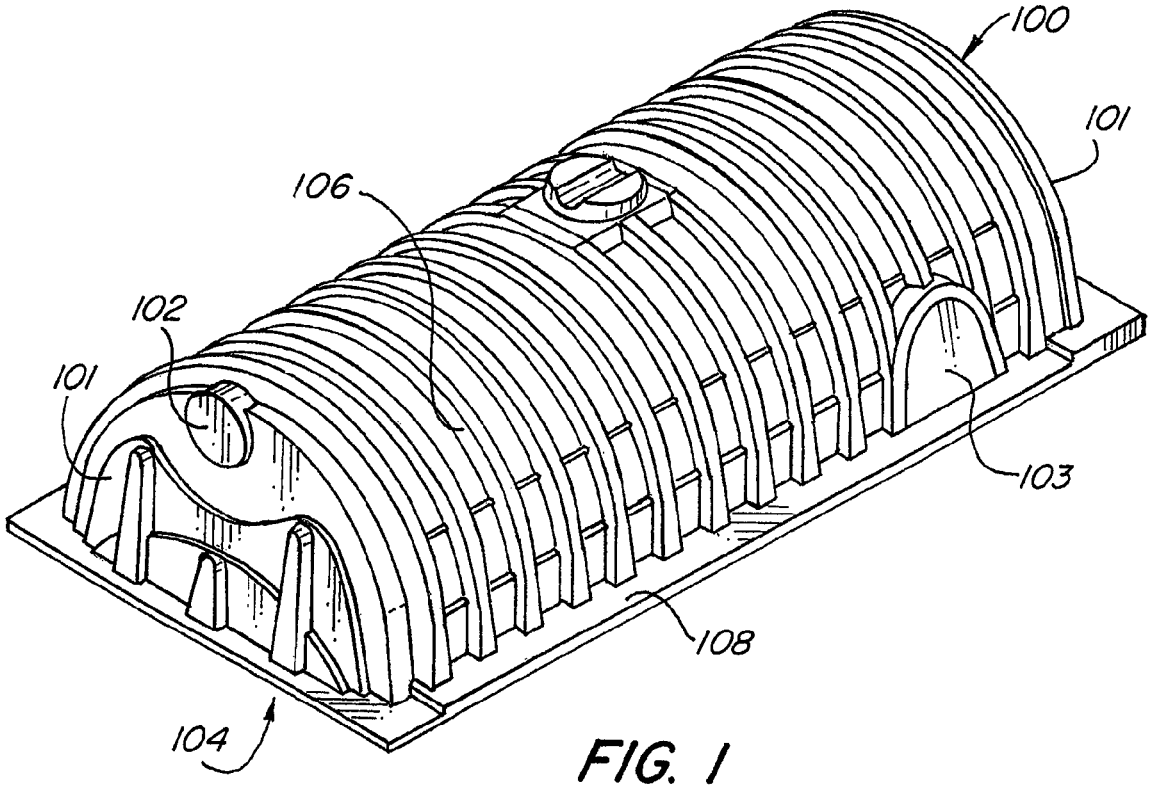
FIG. 1 is a perspective view of one embodiment of a storm water chamber.

Referring now to FIG. 1, a perspective view of one embodiment of a storm water chamber 100 according to the present teachings is shown. Storm water chambers 100 may be used to help collect wastewater, storm water, sewage, or other liquids for storage or dispersal. The storm water chamber 100 may be generally arch-shaped to provide desirable characteristics of chamber volume and strength. It may have a generally elongated arch shape with an arch top and bottom side walls, thereby defining an enclosure, and a plurality of circumferential reinforcing members disposed along the generally elongated arch shape for reinforcing structural strength thereof. Ribs 106 (shown in detail in FIG. 1) will help strengthen the storm water chambers 100 to support any additional weight. The reinforcing members may be ribs 106, although not limited thereto. The storm water chamber 100 may have two closed ends 101, or it may have one closed end 101 and one open end, or it may have two open ends. The use of one closed end 101 and one open end allows the open end to be overlapped with the closed end 101 to connect a plurality of chambers as described in U.S. Pat. No. 5,087,151. In particular storm water chambers 100 may be connected together by means of connector member on an engaging end to create a long, further extendable series of chambers for dispersing liquid over a larger area, discussed further below. If the storm water chamber 100 has ribs 106, one or more of the ribs 106 may be smaller in size, or configured in some other way to accept overlapping engagement with the ribs at an end of a further storm water chamber 100. Chamber 100 has a base area 108, which is essentially a flange around the base of the chamber. Areas 102 and 103 are preferably provided, and can be cut away to serve as a liquid intake opening. Liquid that enters the liquid intake opening may flow through the storm water chamber 100 along its length and disperse through an open bottom 104 to the earth.

Figure 2:
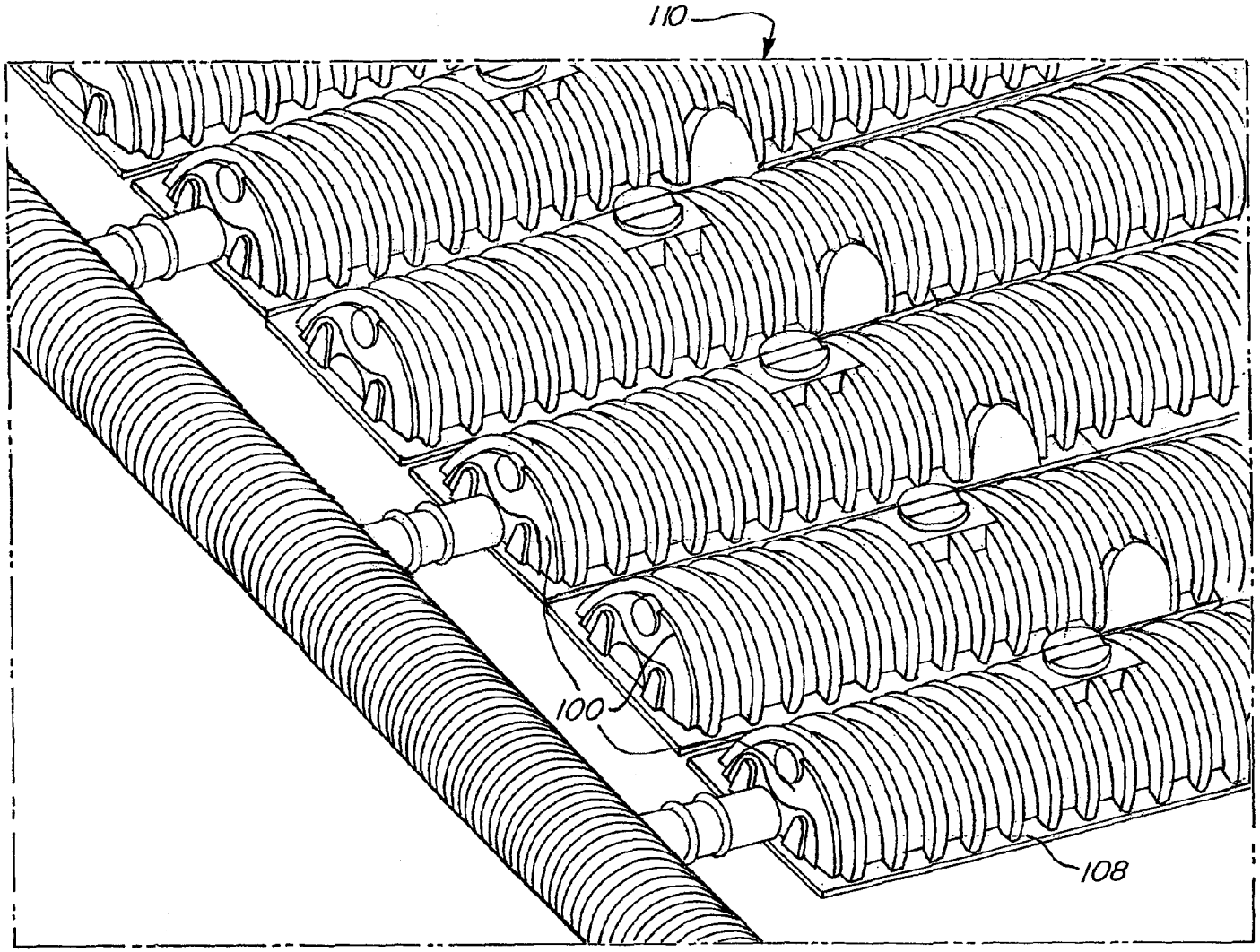
FIG. 2 is a perspective view of one embodiment of a large drainage system incorporating.

Referring now to FIG. 2, shown is a perspective view of one embodiment of a large drainage system 110 incorporating storm water chambers 100 according to the present teachings. The modular design of the storm water chamber 100 permits the creation of an extendable system that can disperse liquid over a wide area of ground. Each storm water chamber 100 may connect with another chamber 100 as discussed above to extend the system. Liquids entering the intake opening can then travel through the series of chambers and disperse through an open bottom 104 (shown in FIG. 1). So constructed, the large drainage system 110 may be covered with earth so as not to occupy valuable ground surface area.

Figure 3:
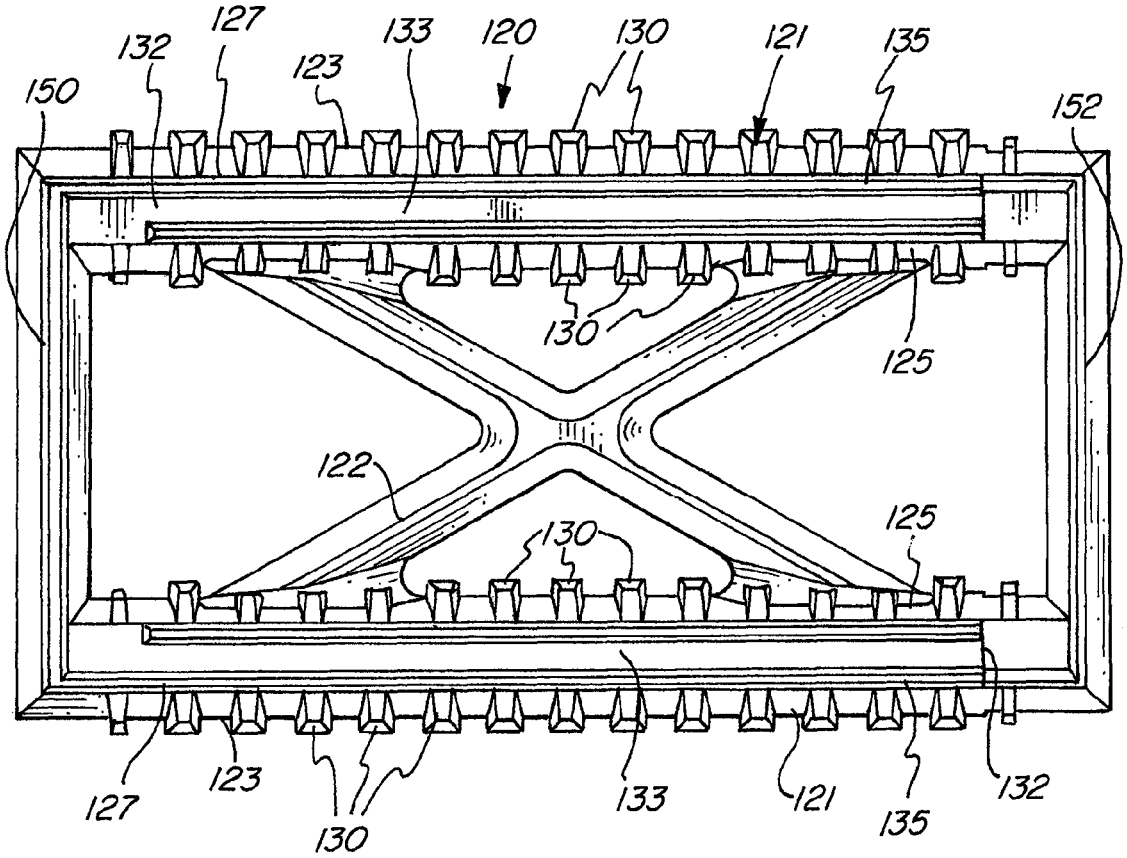
FIG. 3 is a top view of one embodiment of a riser assembly according to the present invention.
Figure 4:
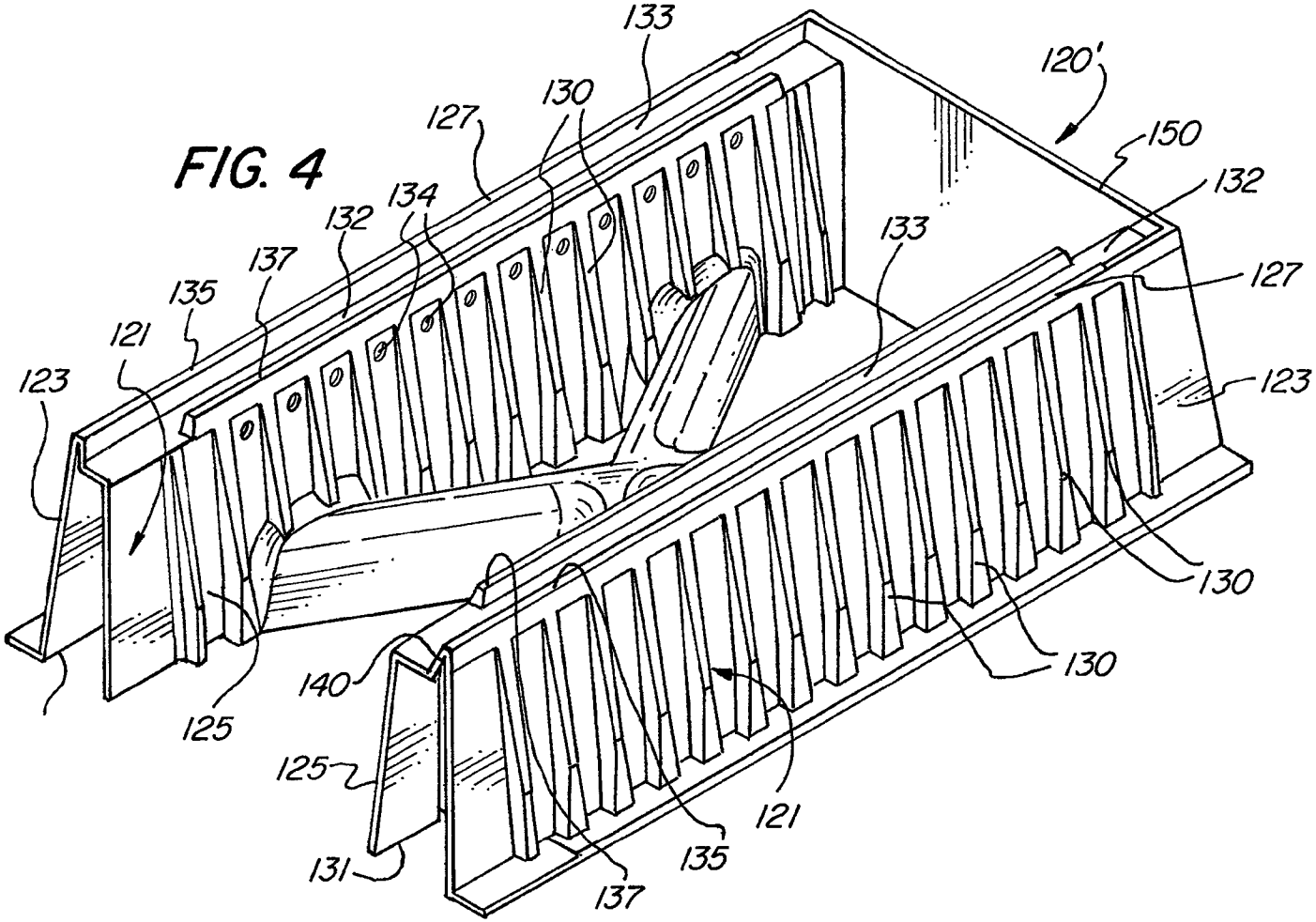
FIG. 4 is a perspective view of one embodiment of a riser assembly according to the present invention.

Referring now to FIG. 3, a top view of one embodiment of a riser assembly 120, and FIG. 4, a perspective view of second embodiment of a riser assembly 120 according to the present invention. The riser assembly 120 may serve as a foundation or base for a storm water chamber 110 (shown in FIG. 1). In such a way, it may provide a larger volume inside of the chamber for liquid storage and dispersal. The riser assembly 120 may be constructed such that it has substantially the same perimeter shape as the storm water chamber 110.

Riser assembly 120 has two generally parallel base assemblies 121. Each base assembly 121 has an outer wall 123 and an inner wall 125 and a top wall 132 connecting the outer wall 123 and the inner wall 125. The top wall 132 has a chamber seating area 133 for receiving a base area 108 of a chamber 100 and a retaining element 127 for retaining the base area 106 of a chamber 100 in position in the chamber seating area 133. Each base assembly 121 has a lower end 131 and is open at its lower end 131. Reinforcing ribs 130 are provided on the inner wall 125, or the outer wall 123, or in both the inner and outer walls 125, 123 of the base assemblies 121. Reinforcing ribs 130 may act like buttresses to support the weight of a storm water chamber 100 and crushed stone that may be placed next to the system.

The retaining element 127 of the base assemblies 121 include a rail 135 located along the top wall above the outer wall of the base assembly. Preferably, the retaining element 127 of the base assemblies 121 is a pair of rails 135 and 137 located along the top wall 132 above the outer wall 123 and inner wall 125 of the base assembly 121. The retaining element 127 may alternatively take the form of a flange, lip, or multiple ones thereof for retaining and/or securing a storm water chamber 100. In one embodiment, although not limited thereto, the flange 132 member may have an extending portion along its length that interacts with a corresponding flange, lip, or other means, on the bottom of a storm water chamber 100. In this way, the retaining element 127 member may retain the storm water chamber 100 and prevent it from coming dislodged from the riser assembly 120. In another embodiment, the pieces could be screwed or clamped together, although not limited thereto.

The riser assemblies preferably include one or more connecting struts 122 extending between the inner walls 125 of the base assemblies 121. Preferably, the connecting struts 122 are two diagonal struts which cross each other to form an X-shaped support. Connecting struts 122 serve to prevent lateral spreading of the base assemblies and to stabilize the riser assembly and the combination of the riser assembly and the chamber. Connecting struts 122 are arch shaped and also serve to transfer liquid between the two base assemblies 121. Preferably, the inner wall 125 of the base assemblies 121 are provided with a plurality of holes 134 to allow for liquid transfer between the interior of the riser assembly 120 and the interior of the base assemblies 121. Holes 134 are preferably positioned at the upper portion of the walls may prevent any sediment such as silt, refuse, etc., from entering the walls and inhibiting liquid flow. In this way, the liquid may have an unobstructed path to flow through the riser assembly 120 walls, even if the primary area in the chamber becomes obstructed.

Figure 6:
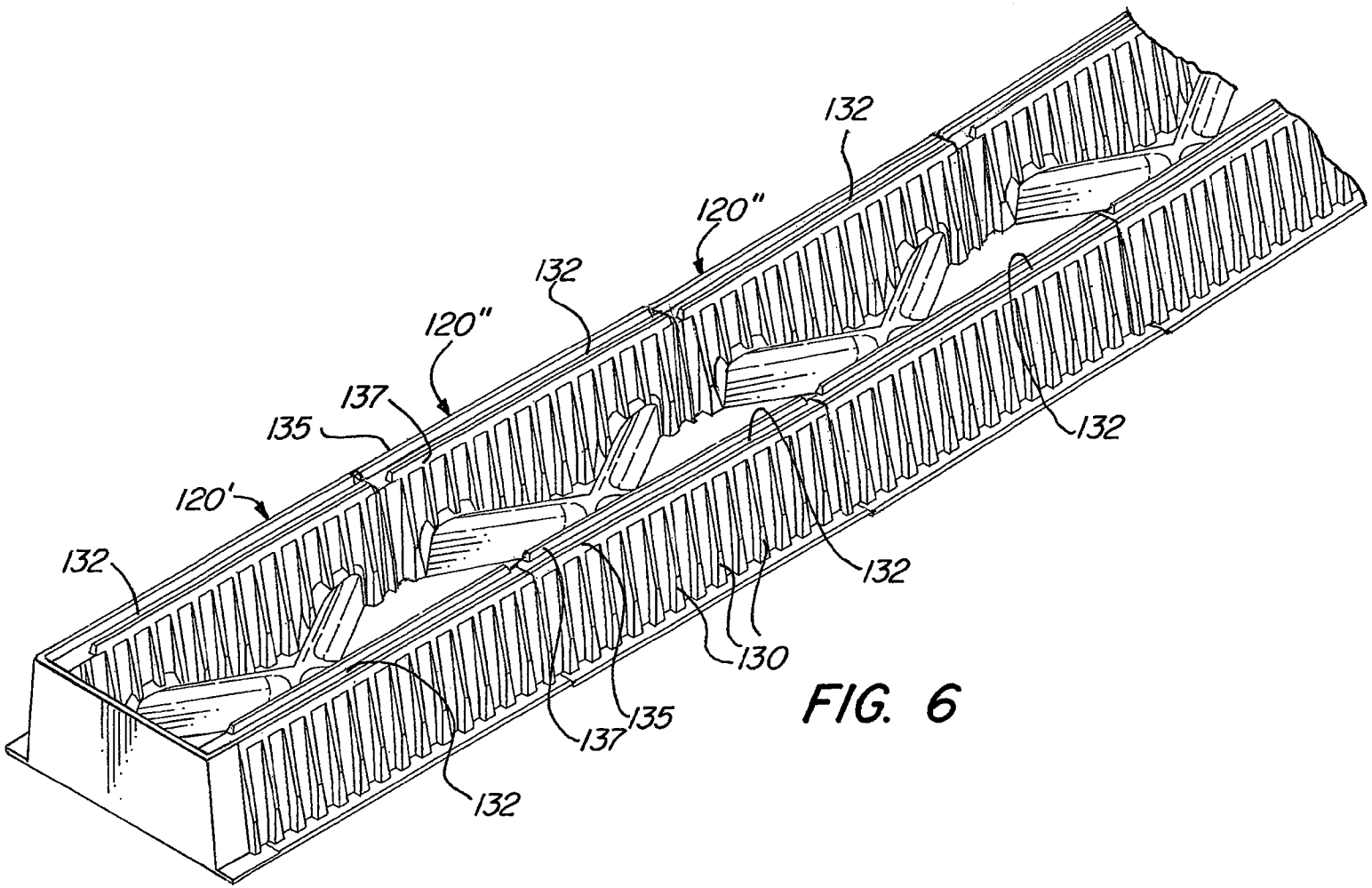
FIG. 6 is a perspective view depicting the connection of several riser assemblies in one embodiment according to the present invention.

The riser assemblies may have two end walls 150, 152 as seen in riser assembly 120 of FIG. 3, or one end wall 150 as seen in riser assembly 120' in FIG. 4, or no end walls as seen in riser assemblies 120" in FIG. 6. The end walls of the riser assembly 120 may be removable, although not limited thereto, in order to easily permit connecting multiple riser assemblies 120 in series, discussed further below. In this way, it may be preferable for riser assemblies 120 in the middle of a series to be without end walls 136 to allow liquid therein to flow freely, while the riser assembly 120 on the end of the series may have an end wall 136 to retain the liquid.

The riser assembly 120 may be constructed from the same material (e.g., plastic, metal, etc.) as the storm water chambers 100, although not limited thereto, and the base assemblies will be nestable and stackable. In this way, several riser assemblies 120 may be stacked on top of each other for efficient shipping. The riser assembly 120 provides additional volume to the storm water chamber 100 that would otherwise only be obtainable by designing larger storm water chambers 100. The two-piece system of the invention which comprises the riser assembly 120 and storm water chamber 100 addresses the issues of weight and unwieldiness in manufacturing, shipping, and installation associated with very large chambers.

Figure 5:
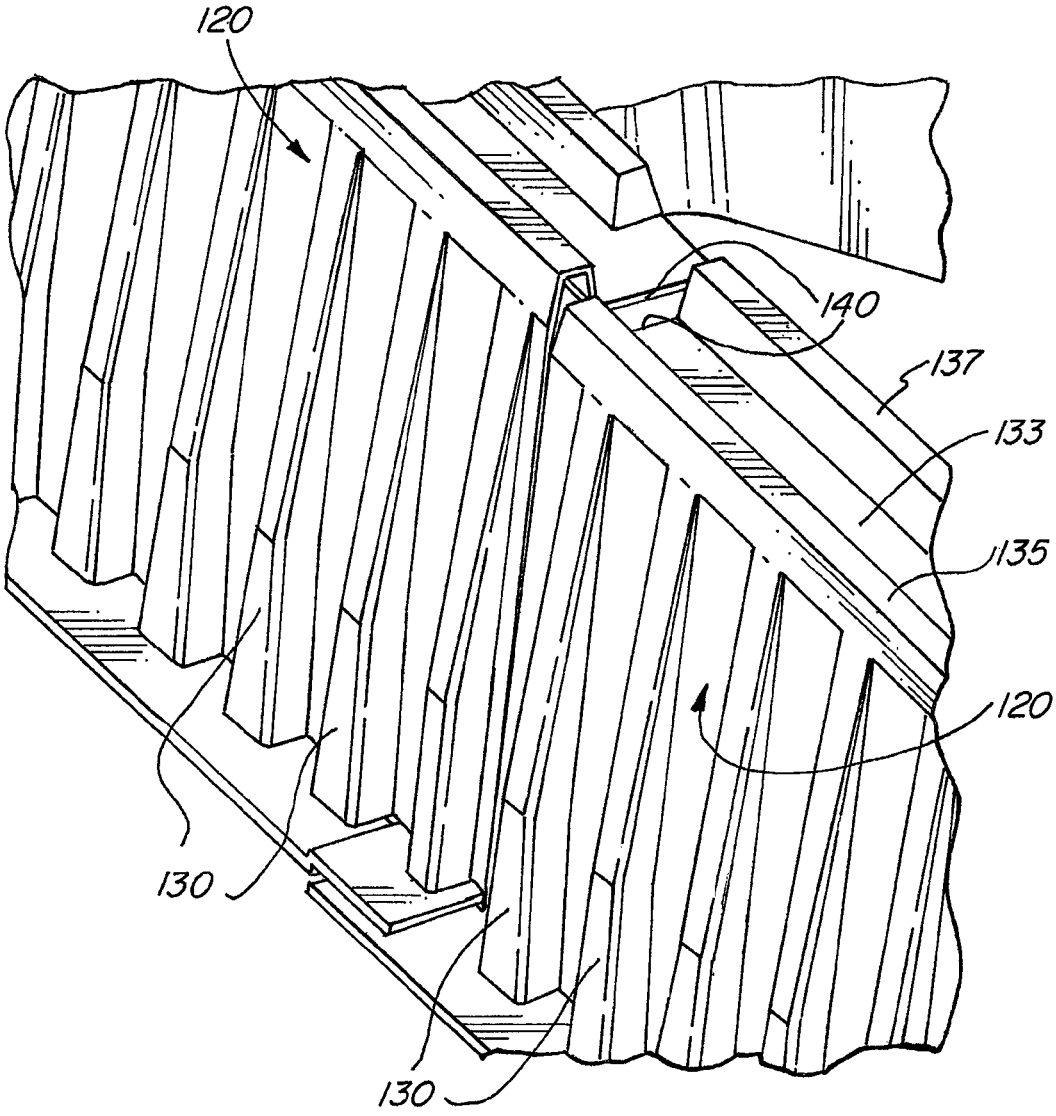
FIG. 5 is a perspective view depicting the connection of two riser assemblies in one embodiment according to the present invention.

One end of each of the base assemblies of one riser assembly is adapted to overlap and seat on the other end of each of the base assemblies of an adjacent riser assembly in order to connect them together in a row. Referring now to FIG. 5, shown is a perspective view depicting the connection of two riser assemblies 120 in one embodiment according to the present teachings. Each end of a riser assembly 120 may have a connector 140 member or other connection means for connecting with a further riser assembly 120 in order to create a series. In one embodiment, although not limited thereto, the outer rib arc 130 or arcs on the end of the riser assembly 120 may be sized such that one riser assembly 120 may overlap another riser assembly 120 to secure them with each other. This may work in a way similar to how the storm water chambers 100 may connect with each other in one embodiment, discussed above. In this way, two or more riser assemblies 120 are held in place by overlapping. In another embodiment, they could be screwed or clamped together, although not limited thereto.

Referring now to FIG. 6, shown is a perspective view depicting the connection of several riser assemblies 120 in one embodiment according to the present teachings. Using a connector 140 (shown in FIG. 4), the riser assemblies 120 may be connected with each other in a series. This allows large drainage systems 110 (shown in FIG. 2) to be constructed with additional volume for liquid provided by the riser assemblies 120.

Figure 7:
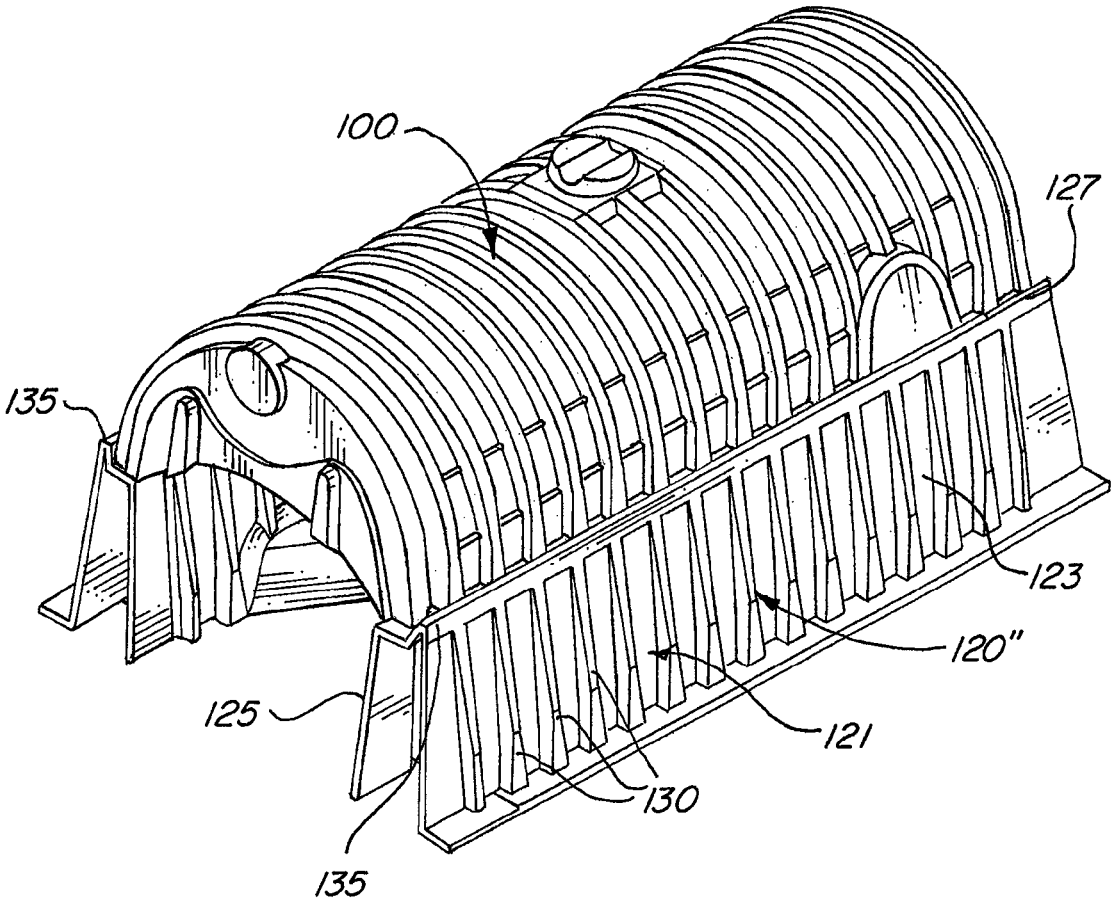
FIG. 7 is a perspective view of one embodiment of a storm water chamber connected with a riser assembly according to the present invention.

Referring now to FIG. 7, shown is a perspective view of one embodiment of a storm water chamber 100 connected with a riser assembly 120 according to the present teachings. When the two pieces are connected with each other, the inside of the storm water chamber 100 is provided with a much larger volume due to the height of the riser assembly 120. The ends of the riser assembly 120 may be closed to retain liquid or open (as shown) in order to allow liquid to flow, which may be preferable when multiple storm water chambers 100 and riser assemblies 120 are connected with each other in a series.

Several dispensing chambers 100 and riser assemblies 120 may be connected together in a series to create a large drainage system 110 (shown in FIG. 2) that extends for long distances. The riser assemblies 120 provide a much larger volume for collecting liquid than just the storm water chamber 100 by itself.

While the present teachings have been described above in terms of specific embodiments, it is to be understood that they are not limited to these disclosed embodiments. Many modifications and other embodiments will come to mind to those skilled in the art to which this pertains, and which are intended to be and are covered by both this disclosure and the appended claims. It is intended that the scope of the present teachings should be determined by proper interpretation and construction of the appended claims and their legal equivalents, as understood by those of skill in the art relying upon the disclosure in this specification and the attached drawings.

What is claimed is:

1. A drainage system, comprising:

a elongated arch shaped chamber having a base area at its lower end; and a riser assembly having two generally parallel hollow base assemblies, each said base assembly having an interior hollow space, each said interior hollow space being defined by an outer wall and an inner wall and a top wall connecting the outer wall and the inner wall, the top wall having an chamber seating area for receiving the base area of the chamber and a retaining element for retaining the base area of a chamber in position in the chamber seating area, one or more hollow connecting struts extending between the inner walls of the base assemblies and providing liquid transfer between the base assemblies.

2. The drainage system of claim 1, wherein each base assembly has a lower end and the interior hollow space is open at its lower end.

3. The drainage system of claim 1, wherein each base assembly is provided with reinforcing ribs in its inner wall, or its outer wall, or in both its inner and outer walls.

4. The drainage system of claim 1, wherein the retaining element of the base assembly includes a rail located along the top wall above the outer wall of the base assembly.

5. The drainage system of claim 4, wherein the retaining element of the base assembly is a pair of rails located along the top wall above the outer wall and inner walls of the base assembly.

6. The drainage system of claim 1, wherein the connecting struts are two diagonal struts which cross each other to form an X-shaped support.

7. The drainage system of claim 1, wherein one end of each of the base assemblies of one riser assembly is adapted to overlap and seat on the other end of each of the base assemblies of a horizontally adjacent riser assembly.

8. The drainage system of claim 7, wherein a plurality of riser assemblies may be connected together by overlapping one ends of the base assemblies with the other end of base assemblies.

9. The drainage system of claim 1, wherein the riser assembly has no end walls, one end wall, or two end walls.

10. The drainage system of claim 1, wherein the inner wall of at least one base assembly is provided with a plurality of holes.

11. The drainage system of claim 1, wherein the riser assembly is nestable and stackable with additional such riser assemblies for shipping or storage.

12. A riser assembly having two generally parallel hollow base assemblies, each said base assembly having an interior hollow space, each said interior hollow space being defined by an outer wall and an inner wall and a top wall connecting the outer wall and the inner wall, the top wall having an chamber seating area for receiving a base area of a chamber and a retaining element for retaining the base area of a chamber in position in the chamber seating area, one or more hollow connecting struts extending between the inner walls of the base assemblies and providing liquid transfer between the base assemblies.

13. The riser assembly of claim 12, wherein each base assembly has a lower end and the interior hollow space is open at its lower end.

14. The riser assembly of claim 13, wherein each base assembly is provided with reinforcing ribs in its inner wall, or its outer wall, or in both its inner and outer walls.

15. The riser assembly of claim 14, wherein the retaining element of the base assembly includes a rail located along the top wall above the outer wall of the base assembly.

16. The riser assembly of claim 15, wherein the retaining element of the base assembly is a pair of rails located along the top wall above the outer wall and inner walls of the base assembly.

17. The riser assembly of claim 12, wherein the connecting struts are two diagonal struts which cross each other to form an X-shaped support.

18. The riser assembly of claim 12, wherein one end of each of the base assemblies of one riser assembly is adapted to overlap and seat on the other end of each of the base assemblies of a horizontally adjacent riser assembly.

19. The riser assembly of claim 18, wherein the riser assembly has no end walls, one end wall, or two end walls.

20. The riser assembly of claim 19, wherein the inner wall of at least one base assembly is provided with a plurality of holes.

21. The riser assembly of claim 20, wherein the riser assembly is nestable and stackable with additional such riser assemblies for shipping or storage.

22. A method of installing a drainage system, comprising:

positioning a plurality of riser assemblies, each said riser assembly having two generally parallel hollow base assemblies, each said base assembly having an interior hollow space, each said interior hollow space being defined by an outer wall and an inner wall and a top wall connecting the outer wall and the inner wall, the top wall having an chamber seating area for receiving a base area of a chamber and a retaining element for retaining the base area of a chamber in position in the chamber seating area, one or more hollow connecting struts extending between the inner walls of the base assemblies and providing liquid transfer between the base assemblies;

said plurality of riser assemblies being positioned in an end-to-end fashion by overlapping and seating one end of each base assembly on the other end of base assemblies of an adjacent riser assembly;

positioning a plurality of elongated arch shaped chambers having base areas at their lower ends in the chamber seating areas of the riser assemblies.

* * * * *